United States Patent [19]

Rosenthal

[11] 4,391,699

[45] * Jul. 5, 1983

[54] COAL LIQUEFACTION PROCESS

[75] Inventor: Joel W. Rosenthal, El Cerrito, Calif.

[73] Assignee: Chevron Research Company, San Francisco, Calif.

[ * ] Notice: The portion of the term of this patent subsequent to May 18, 1999, has been disclaimed.

[21] Appl. No.: 345,281

[22] Filed: Feb. 3, 1982

Related U.S. Application Data

[63] Continuation of Ser. No. 754,198, Dec. 27, 1976, Pat. No. 4,330,389.

[51] Int. Cl.[3] ..... C10G 1/00; C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,143,489 | 8/1964 | Gorin | 208/8 |
| 3,488,279 | 1/1970 | Schulman | 208/10 |
| 3,583,900 | 6/1971 | Gatsis | 208/8 |
| 3,594,303 | 7/1971 | Kirk, Jr. et al. | 208/8 |
| 3,687,837 | 8/1972 | Fiocco et al. | 208/8 |
| 3,726,784 | 4/1973 | Correa | 208/8 |
| 3,840,456 | 10/1974 | Yavorsky et al. | 208/10 |
| 3,852,183 | 12/1974 | Snell | 208/10 |
| 3,892,654 | 7/1975 | Wright et al. | 208/8 |
| 3,925,188 | 12/1975 | Lester | 208/8 |
| 3,932,266 | 1/1976 | Sze et al. | 208/10 |
| 3,957,619 | 5/1976 | Chun et al. | 208/10 |
| 3,997,425 | 12/1976 | Gatsis | 208/8 |
| 4,018,663 | 4/1977 | Karr, Jr. | 208/10 |
| 4,028,221 | 6/1977 | Sze et al. | 208/8 |
| 4,057,484 | 11/1977 | Malek | 208/8 |
| 4,110,192 | 8/1978 | Hildebrand et al. | 208/8 |
| 4,111,788 | 9/1978 | Chervenak et al. | 208/10 |

OTHER PUBLICATIONS

"Clean Fuels-West—Coal Liquefaction Development Program, Phase 1, Technical Summary", Nov. 1975, Conoco Coal Development Company.

*Primary Examiner*—Delbert E. Gantz
*Assistant Examiner*—William G. Wright
*Attorney, Agent, or Firm*—D. A. Newell; S. R. La Paglia; S. H. Roth

[57] ABSTRACT

Disclosed is a two-stage process for the production of liquid hydrocarbons from coal. More particularly, disclosed is a two-stage coal liquefaction process wherein subdivided coal is substantially dissolved in a solvent in a first non-catalytic dissolving stage at the temperature in the range 750° to 900° F. In a second stage, the mixture of solvent, dissolved coal and insoluble solids is contacted with a hydrocracking catalyst at a critical temperature below 800° F. The normally liquid portion of the hydrocracker effluent product has a surprisingly low sulfur content of less than 0.1 weight percent, a low nitrogen content of less than 0.5 weight percent, and a high API gravity of at least −3.

28 Claims, 1 Drawing Figure

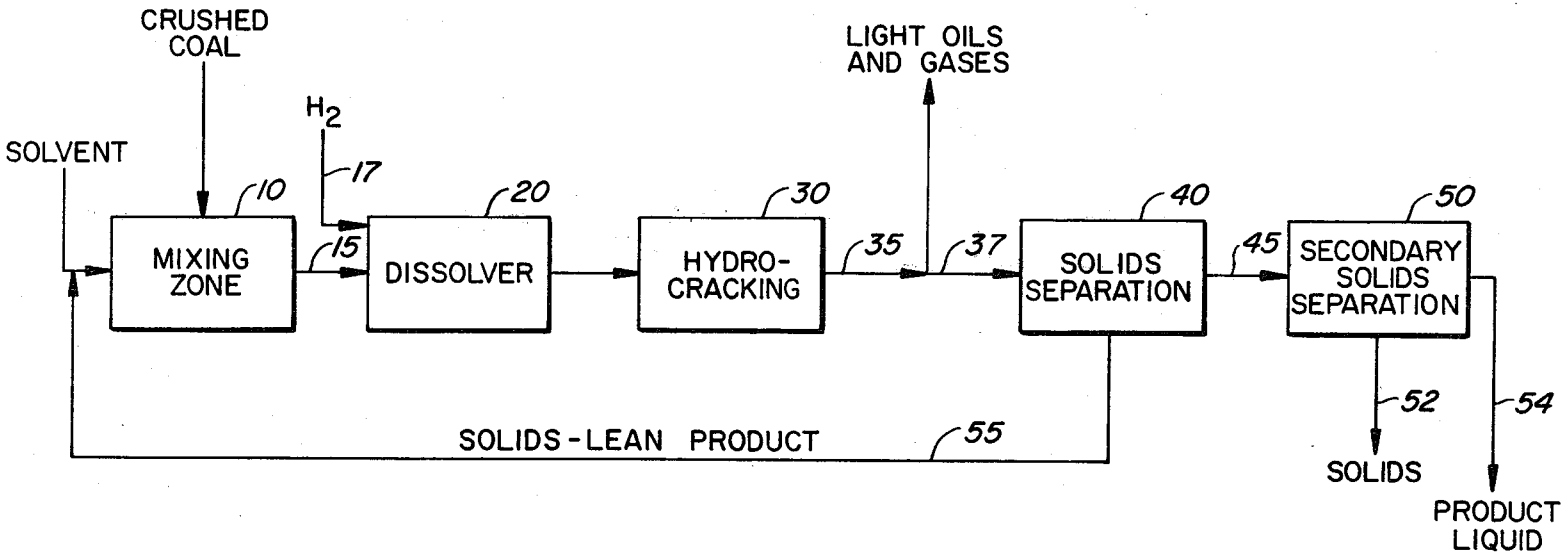
CRUSHED COAL
SOLVENT
MIXING ZONE
10
$H_2$
17
15
DISSOLVER
20
HYDRO-CRACKING
30
35
LIGHT OILS AND GASES
37
SOLIDS SEPARATION
40
45
SECONDARY SOLIDS SEPARATION
50
52
SOLIDS
54
PRODUCT LIQUID
55
SOLIDS-LEAN PRODUCT

COAL LIQUEFACTION PROCESS

This is a continuation of application Ser. No. 754,198, filed Dec. 27, 1976, now U.S. Pat. No. 4,330,389.

BACKGROUND OF THE INVENTION

The present invention relates to the liquefaction of coal to produce a normally liquid product which is low in sulfur and nitrogen and has a particularly high API gravity.

As a consequence of the increasing costs and diminishing supplies of petroleum much research is being conducted into better ways of obtaining synthetic fuels from solids such as coal. Furthermore, as a consequence of increased emphasis on the reduction of air pollution, fuels with low sulfur and low nitrogen contents are in great demand. Unfortunately, however, most coals contain large amounts of sulfur and nitrogen which end up in the synthetic liquids produced from the coal which necessitates additional costly sulfur and nitrogen removal steps, further increasing the costs of the synthetic fuels.

Numerous processes are well known in the art for the production of liquid products from coal.

In many processes for coal liquefaction, hydrogen is supplied by a liquid donor solvent. In such processes, the function of any catalyst is to rehydrogenate the solvent by adding molecular hydrogen to it. Thus the solvent acts as a medium to carry hydrogen from the catalyst to the solid coal. However, in such processes the catalyst is typically rapidly deactivated with the result that the process is highly inefficient and not conducive to a commercial coal hydrogenation process.

Another problem with prior art processes results from the insoluble solids which are contained in the liquid product. Typically, the liquid product from a coal liquefaction process has a high molecular weight. The high molecular weight of the product makes it very difficult to separate the very fine insoluble solids (coal residue). Furthermore, it has generally been taught that these insoluble solids must be separated prior to further processing in order to prevent downstream catalyst deactivation.

A further problem of prior art coal liquefaction processes is that the normally liquid product typically contains 0.2 to 1.0 or more weight percent sulfur and nitrogen. These potential pollutants must be removed in order to produce a valuable clean fuel and the removal of these contaminants requires costly additional hydroprocessing steps which further increase the cost of the product.

Typical of the prior art processes is the Gulf catalytic coal liquefaction process, disclosed in *Coal Conversion Technology,* Smith et al, Noyes Data Corporation (1976), where a slurry of coal and a process-derived solvent is forced up through a bed of catalyst at 900° F. and 2000 psig. The product, as taught in Sun W. Chun, National Science Foundation, Ohio State University Workshop, "Materials Problems and Research", Apr. 16, 1974, has a gravity of 1.2°API, a sulfur content of 0.11 weight percent, and a nitrogen content of 0.63 weight percent.

Another typical and well-known prior art process is the Synthoil process wherein a coal solvent slurry is pumped into a catalytic fixed bed reactor with hydrogen at a high velocity. Similar to the Gulf process, the Synthoil process also produces a liquid product, as taught in "Coal Liquefaction", Sam Friedman et al, presented at NPRA National Fuels & Lubricants Meeting, November 6–8, 1974, Houston, Texas, which has a gravity of −0.72°API and a sulfur content of 0.2 weight percent.

SUMMARY OF THE INVENTION

A process for liquefying coal, which comprises:

(a) forming a coal-solvent slurry by mixing subdivided coal with a solvent;

(b) substantially dissolving said coal in said solvent by heating said slurry to a temperature between 750° and 950° F. thereby forming a mixture comprising solvent, dissolved coal, and insoluble solids;

(c) contacting said mixture in a reaction zone with hydrogen and a hydrocracking catalyst under hydrocracking conditions including a temperature below 800° F.; and (d) withdrawing from said reaction zone an effluent stream, the normally liquid portion of which has an API gravity greater than −3.

Furthermore, the normally liquid portion of the product has an extremely low sulfur content of less than 0.10 weight percent and a nitrogen content less than 0.50 weight percent.

BRIEF DESCRIPTION OF THE DRAWING

The drawing is a schematic flow diagram of one preferred embodiment of the invention.

DETAILED DESCRIPTION OF THE INVENTION AND PREFERRED EMBODIMENTS

One object of the present invention is to provide an improved process for the liquefaction of coal whereby a normally liquid product is obtained having an API gravity of at least −3, a low sulfur content of less than 0.10 weight percent, and a low nitrogen content of less than 0.50 weight percent.

Another object of the present invention is to produce a solids-free, normally liquid product which is particularly useful as a turbine fuel.

Still another object of the present invention is to produce a liquid product from which insoluble coal solids (coal ash) can be more easily and economically removed, for example, by gravity settling.

It is an essential feature and critical to obtaining the above objects that the process of the present invention be carried out in at least two separate and distinct stages under critical process conditions. It is essential that the coal is substantially dissolved in a high temperature first stage in the range 750° to 900° F. to produce a mixture of dissolved coal, solvent and insoluble solids followed by contacting the mixture with a hydrocracking catalyst in a second state under hydrocracking conditions including a critical temperature below 800° F. and preferably in the range of 600° to 799° F. Preferably the temperature in the hydrocracking stage will always be below the temperature in the dissolving zone, preferably 100° to 150° F. lower.

In order to further describe the invention, reference is made to the FIGURE which represents one preferred embodiment of the invention.

Subdivided coal, together with a hydrogen donor solvent, is fed into a mixing zone 10. The basic feedstock of the present invention is a solid subdivided coal such as anthracite, bituminous coal, subbituminous coal, lignite and mixtures thereof. Particularly preferred are the bituminous and subbituminous coals. Generally, it is desired to grind the coal to a particle size distribution from about 100 mesh and finer. However, larger sizes casn be utilized.

The solvent materials are well known in the art and comprise aromatic hydrocarbons which are partially hydrogenated, generally having one or more rings at least partially saturated. Several examples of such materials are tetralin (tetrahydronaphthalene), dihydronaphthalene, dihydroalkylnaphthalenes, dihydrophenanthrene, dihydroanthracene, dihydrochrysenes and the like. It will be understood that these materials may be obtained from any source, but are most readily available from the product of the present invention. It is most preferred to use a solvent obtained from the process, more particularly, a portion of the 400° F. and higher boiling fraction obtained from fractionation of the hydrocracking zone effluent as described later herein.

The subdivided coal is mixed with a solvent in a solvent-coal weight ratio from about 1:2 to 3:1, preferably from about 1:1 to 2:1. From mixing zone 10 the slurry is fed through line 15 to the dissolving zone 20. In dissolving zone 20, the slurry is heated to a temperature in the range of 750° to 900° F., preferably 800° to 850° F., and more preferably 820° to 840° F., for a length of time sufficient to substantially dissolve the coal. At least 50 weight percent and more preferably greater than 70 percent, and still more preferably greater than 90 percent, of the coal, on a moisture and ash-free basis, is dissolved in zone 20, thereby forming a mixture of solvent, dissolved coal and insoluble solids. It is essential that the slurry be heated to at least 750° F. to obtain at least 50 percent dissolution of the coal. Further, it is essential that the coal not be heated to higher temperatures above 900° F. since this results in thermal cracking which substantially reduces the yield of normally liquid products.

Preferably, hydrogen is also introduced into the dissolving zone through line 17 and comprises fresh hydrogen and recycle gas. Except for the temperature, reaction conditions in the dissolving zone can vary widely in order to obtain the minimum of at least 50 percent dissolution of solids. Other reaction conditions in the dissolving zone include a residence time of 0.01 to 3 hours, preferably 0.1 to 1.0 hour, a pressure in the range 0 to 10,000 psig, preferably 1500 to 5000 psig, and more preferably 1500 to 2500 psig, a hydrogen gas rate of 0 to 20,000 standard cubic feet per barrel of slurry, and preferably 3000 to 10,000 standard cubic feet per barrel of slurry. If hydrogen is added to the dissolving zone, then it is preferred to maintain the pressure in the dissolving zone above 500 psig. The slurry may flow upwardly or downwardly in the dissolving zone. Preferably the zone is elongated sufficiently such that plug flow conditions are approached which allow one to operate the process of the present invention on a continuous basis rather than on a batch operation basis.

The dissolving zone contains no catalyst from any external source although the mineral matter contained in the coal may have some catalytic effect.

The mixture of dissolved coal, solvent and insoluble solids is fed into a second stage reaction zone 30 containing a hydrocracking catalyst. In the hydrocracking zone, hydrogenation and cracking occur simultaneously, and the higher-molecular-weight compounds are converted to lower-molecular-weight compounds, the sulfur compounds are converted to hydrogen sulfide, the nitrogen compounds are converted to ammonia, and oxygen compounds are converted to water. Preferably, the catalytic reaction zone is a fixed-bed type, but an ebullating bed can also be utilized. The mixture of gas, liquids and insoluble solids preferably passes upwardly through the catalytic reaction zone, but may also pass downwardly.

The catalysts used in the second stage of the process may be any of the well-known and commercially available hydrocracking catalysts. A suitable catalyst for use in the hydrocracking reaction stage comprises a hydrogenation component and a cracking component. Preferably, the hydrogenation component is supported on a refractory cracking base. Suitable cracking bases include, for example, two or more refractory oxides such as silica-alumina, silica-magnesia, silica-zirconia, alumina-boria, silica-titania, silica-zirconia-titania, acid-treated clays and the like. Acidic metal phosphates such as alumina phosphate may also be used. Preferred cracking bases comprise composites of silica and alumina. Suitable hydrogenation components are selected from Group VI-B metals, Group VIII metals, their oxides or mixtures thereof. Particularly useful are cobalt-molybdenum, nickel-molybdenum, or nickel-tungsten on silica-alumina supports.

It is critical to the process of the present invention that the temperatures in the hydrocracking zone is not too high because it has been found that the catalyst is rapidly fouled at high temperatures. The temperature in the hydrocracking zone must be maintained below 800° F., preferably in the range 650° to 799° F., and more preferably 650° to 750° F. Generally the temperature in the hydrocracking zone will always be below the temperature in the dissolving zone and preferably 100° to 150° F. lower. Other hydrocracking conditions include a pressure from 500 to 5000 psig, preferably 1000 to 3000 psig, and more preferably 1500 to 2500 psig, hydrogen rate of 2000 to 20,000 standard cubic feet per barrel of slurry, preferably 3000 to 10,000 standard cubic feet per barrel of slurry and a slurry hourly space velocity in the range 0.1 to 2, preferably 0.2 to 0.5.

Preferably, the pressure in the noncatalytic dissolving stage and the catalytic hydrocracking stage are essentially the same.

Preferably the entire effluent from the dissolving zone is passed to the hydrocracking zone. However, since small amounts of water and light gases ($C_1$ to $C_4$) are produced in the first stage, the catalyst in the second stage is subject to a lower hydrogen partial pressure than if these materials were absent. Since higher hydrogen partial pressures tend to increase catalyst life, it may be preferable in a commercial operation to remove a portion of the water and light gases before the stream enters the hydrocracking stage.

The product effluent 35 from reaction zone 30 is separated into a gaseous fraction 36 and a solids-liquid fraction 37. The gaseous fraction comprises light oils boiling below about 300° to 500° F., preferably below 400° F., and normally gaseous components such as $H_2$, CO, $CO_2$, $H_2S$ and the $C_1$ to $C_4$ hydrocarbons. Preferably the $H_2$ is separated from the other gaseous components and recycled to the hydrocracking or dissolving stages as desired. The liquids-solid fraction 37 is fed to solids separation zone 40 wherein the stream is separated into a solids-lean stream 55 and solids-rich stream 45. The insoluble solids are separated by conventional means, for example, hydrocyclones, filtration, centrifugation and gravity settling or any combination of these. Preferably, the insoluble solids are separated by gravity settling which is a particularly added advantage of the present invention since the effluent from the hydrocracking reaction zone has a particularly low viscosity and a high API gravity of at least −3. The high API gravity of the effluent allows rapid separation of the solids by gravity settling such that 50 weight percent and generally 90 weight percent of the solids can be rapidly separated in a gravity settler. Preferably, the insoluble solids are removed by gravity settling at an elevated temperature in the range 200° F., preferably 300° to 400° F., and at a pressure in the range 0 to 5000 psig, preferably 0 to 1000 psig. Separation of the solids at an elevated temperature and pressure is particularly desirable. The solids-lean product stream is removed via line 55 and recycled to the mixing zone, while the solids-rich stream is passed to secondary solids separation zone 50 via line 45. Zone 50 may include distillation, fluid coking, delayed coking, centrifugation, hydrocloning, filtration, settling, or any combination of the above. The separated solids are removed from zone 50 via line 52 and disposed of while the product liquid is removed via line 54. The liquid product is essentially solids-free and contains less than 1.0 weight percent solids.

The process of the present invention produces extremely clean, normally liquid products. The normally liquid products, that is, all of the product fractions boiling above $C_4$, have an unusually high API gravity of at least −3, preferably above 0 and more preferably above 5; a low sulfur content of less than 0.1 weight percent, preferably less than 0.02; and a low nitrogen content less than 0.5 weight percent, preferably less than 0.2 weight percent.

As is readily apparent from the drawing, the process of the present invention is extremely simple and produces clean, normally liquid products from coal which are useful for many purposes. The broad-range product is particularly useful as a turbine fuel, while particular fractions are useful for gasoline, diesel, jet, and other fuels.

The advantages of the present invention will be readily apparent from a consideration of the following examples.

EXAMPLE 1

A slurry consisting of 33 weight percent Illinois #6 coal and 67 weight percent recycle oil was passed sequentially through a first-stage dissolving zone and a second-stage hydrocracking zone. The coal was 100-minus mesh coal and had the following analysis on a weight-percent dry basis: C—64, H—4.5, N—1.0, o—12.5, S—4.0, ash—14.0. The solvent (recycle oil) was a 400° F.+ fraction obtained from a previous run. Hydrogen was introduced into the first stage at a rate equal to 10,000 SCF/bbl of slurry. The slurry had a residence time of 1.4 hours in the first stage, which was maintained at 2400 psig and 835° F. The mixture of gases, liquids, and solids was then passed entirely to the second stage, which contained a fixed bed of a hydrocracking catalyst consisting of 6.6 weight percent nickel and 19.2 weight percent tungsten with an alumina base. The second stage was maintained at 2400 psig and 670° F. and the space velocity based on the feed slurry was 0.25. The effluent was separated into recycle liquid (400° F.+) and coal-derived product. The yields are shown below, after 1300 hours of operation.

| Product | Wt. % of Dry Coal |
|---|---|
| $C_1$–$C_3$ | 8.2 |
| $C_4$–400 | 2.5 |
| 400–700 | 39.7 |
| 700–875 | 10.2 |
| 875+ oil | 11.1 |
| Unreacted coal | 6.0 |
| Ash | 13.5 |
| $NH_3$, $H_2S$, $H_2O$ | 13.9 |

The normally liquid product, that is, the $C_4$ through 875+ fractions, had the following properties: °API, 8; nitrogen, 0.2 weight percent; oxygen, 0.69 weight percent; and sulfur, 0.03 weight percent.

EXAMPLE 2

A slurry consisting of 25 weight percent 100-minus mesh Illinois #6 coal and 75 weight percent coal-derived oil (400° F.+) was passed sequentially through a first-stage dissolving zone and a second-stage hydrocracking zone as in Example 1. First-stage operating conditions included a temperature of 835° F. and 2400 psig. Hydrogen was introduced into the first stage at a rate equal to 10,000 SCF/bbl of slurry. The slurry had a residence time of 0.67 hours in the first stage. The entire mixture of gases, liquids and solids was then passed entirely to the second stage, which contained a hydrocracking catalyst. The second stage was maintained at 2400 psig and initially at 825° F. After 67 hours, the product quality had dropped from 9.5°API to 1°API. The temperature was then raised to 835° F. and the product gravity rose to 3.5°API, but dropped to 0°API after another 65 hours. At 835° F., the catalyst had reached the end of its useful activity and coking began to hinder further operation.

Comparison of Examples 1 and 2 illustrates the criticality of maintaining a low temperature in the hydrocracking stage of the process of the present invention.

What is claimed is:

1. A process for liquefying coal comprising:

(a) mixing subdivided coal with a solvent to form a coal-solvent slurry;

(b) heating said slurry in a dissolving zone to a temperature in the range of 750°–900° F. at a pressure above 500 psig in the presence of added hydrogen to form a first effluent comprising normally liquid components, non-distillable oil components, and undissolved solids;

(c) passing at least a portion of said first effluent into a reaction zone, said portion comprising non-distillable oil components, and contacting said portion with hydrogen in the presence of an externally provided hydrogenation catalyst under hydrogenation conditions, including a temperature below 800° F. and lower than the temperature in said dissolving zone;

(d) withdrawing a second effluent from said reaction zone, said second effluent comprising normally liquid components and non-distillable oil components; and (e) recycling at least a portion of said second effluent to step (a), said recycle portion comprising both normally liquid components and non-distillable oil components.

2. The process according to claim 1 wherein substantially all of said normally liquid components and said non-distillable oil components from said dissolving zone are passed into said reaction zone.

3. The process according to claim 1 wherein said portion of said first effluent comprises a full boiling range portion of said normally liquid components and said non-distillable oil components.

4. The process according to claim 3 wherein substantially all of said non-distillable oil components from said dissolving zone are passed into said reaction zone.

5. The process according to claim 1, 2, 3, or 4 wherein said coal-solvent slurry is heated in said dissolving zone in the absence of an externally supplied catalyst or contact particles.

6. The process according to claim 1, 2, 3, or 4 wherein said step (c) comprises passing said portion of said first effluent mixture upwardly through a fixed bed comprising said hydrogenation catalyt.

7. The process according to claim 1, 2, 3, or 4 wherein said hydrogenation catalyst comprises one or more elements selected from Group VIB and Group VIII on a refractory oxide support comprising material selected from the group consisting of alumina, silica-alumina, silica-magnesia, silica-zirconia, alumina-boria, silica-titania, silica-zirconia-titania, and acid-treated clays.

8. The process according to claim 7 wherein said support is alumina.

9. The process according to claim 1, 2, 3, or 4 wherein the temperature in said reaction zone is at least 100° F. lower than the temperature in said dissolving zone.

10. The process according to claim 1, 2, 3 or 4 wherein the temperature in said reaction zone is at least 150° F. lower than the temperature in said dissolving zone.

11. The process according to claim 1, 2, 3, or 4 wherein said hydrogenation conditions in said reaction zone include a temperature within the range of 650°-750° F. and a pressure within the range of 1000 to 3000 psig.

12. The process according to claim 5 wherein said hydrogenation conditions in said reaction zone include a temperature within the range of 650°-750° F. and a pressure within the range of 1000 to 3000 psig.

13. The process according to claim 1, 2, 3, or 4 wherein said hydrogenation conditions in said reaction zone include a temperature within the range of 650°-750° F. and a pressure within the range of 1500 to 2500 psig.

14. The process according to claim 5 wherein said hydrogenation conditions in said reaction zone include a temperature within the range of 650°-750° F. and a pressure within the range of 1500 to 2500 psig.

15. The process according to claim 10 wherein said support is alumina.

16. A process for liquefying coal comprising:

(a) mixing subdivided coal with a solvent to form a coal-solvent slurry, and solvent comprising non-distillable oil components;

(b) heating said slurry in a dissolving zone to a temperature in the range of 750°-900° F. at a pressure above 500 psig in the presence of added hydrogen to form a first effluent comprising normally liquid components, non-distillable oil components, and undissolved solids;

(c) passing at least a portion of said first effluent into a reaction zone, said portion comprising normally liquid components and non-distillable oil components, and contacting said portion with hydrogen in the presence of an externally provided hydrogenation catalyst under hydrogenation conditions, including a temperature below 800° F. and lower than the temperature in said dissolving zone; and (d) withdrawing a second effluent from said reaction zone, said second effluent containing normally liquid components and non-distillable oil components.

17. The process according to claim 16 wherein substantially all of said normally liquid components and said non-distillable oil components from said dissolving zone are passed to said reaction zone.

18. The process according to claim 16 wherein said portion of said first effluent comprises normally liquid components and is passed from said dissolving zone to said reaction zone without fractionation of normally liquid components in said first effluent.

19. The process according to claim 16 wherein substantially all of said non-distillable oil components from said dissolving zone are passed to said reaction zone.

20. The process according to claim 16, 17, 18 or 19 wherein said coal-solvent slurry is heated in said dissolving zone in the absence of any externally supplied catalyst or contact particles.

21. The process according to claim 16, 17, 18 or 19 wherein said step (c) comprises passing said portion of said first effluent mixture upwardly through a fixed bed comprising said hydrogenation catalyst.

22. The process according to claim 16, 17, 18, or 19 wherein said hydrogenation catalyst comprises one or more elements selected from Group VIB and Group VIII on a refractory oxide support comprising material selected from the group consisting of alumina, silica-alumina, silica-magnesia, silica-zirconia, alumina-boria, silica-titania, silica-zirconia-titania, and acid-treated clays.

23. The process according to claim 16, 17, 18, or 19 wherein the temperature in said reaction zone is at least 100° F. lower than the temperature in said dissolving zone.

24. The process according to claim 16, 17, 18, or 19 wherein the temperature in said reaction zone is at least 150° F. lower than the temperature in said dissolving zone.

25. The process according to claim 16, 17, 18, or 19 wherein said hydrogenation conditions in said reaction zone include a temperature within the range of 750°-850° F. and a pressure within the range of 1000 to 3000 psig.

26. The process according to claim 20 wherein said hydrogenation conditions in said reaction zone include a temperature within the range of 750°-850° F. and a pressure within the range of 1000 to 3000 psig.

27. The process according to claim 16, 17, 18, or 19 wherein said hydrogenation conditions in said reaction zone include a temperature within the range of 750°-850° F. and a pressure within the range of 1500 to 2500 psig.

28. The process according to claim 20 wherein said hydrogenation conditions in said reaction zone include a temperature within the range of 750°-850° F. and a pressure within the range of 1500 to 2500 psig.

* * * * *